United States Patent [19]

McCorry

[11] Patent Number: 4,817,941

[45] Date of Patent: Apr. 4, 1989

[54] ADJUSTABLE TARGET HOLDER FOR MARTIAL ARTS TRAINING

[76] Inventor: Tim McCorry, 326 Gwynedd Ct., Exton, Pa. 19341

[21] Appl. No.: 103,953

[22] Filed: Oct. 2, 1987

[51] Int. Cl.[4] ..... A63B 69/00

[52] U.S. Cl. ..... 272/76; 272/78

[58] Field of Search ..... 272/76–78; 273/55 A, 55 B, 79, 80 D, 81.2, 81.3; 403/325, 327, 328, 361, 84, 93, 103

[56] References Cited

U.S. PATENT DOCUMENTS

| | | | |
|---|---|---|---|
| 1,213,492 | 1/1917 | Hughes | 403/325 X |
| 1,733,709 | 10/1929 | Zinnow et al. | 272/78 |
| 1,844,410 | 2/1932 | Schalk | 403/327 |
| 2,435,864 | 2/1948 | Adams | 272/78 |
| 3,336,060 | 8/1967 | Bradford | 403/325 X |
| 4,403,772 | 9/1983 | Stangle | 272/78 |
| 4,491,316 | 1/1985 | Prince | 272/76 X |
| 4,572,504 | 2/1986 | DiBartolo | 272/76 |
| 4,583,730 | 4/1986 | Gecht et al. | 272/76 |
| 4,662,630 | 5/1987 | Dignard et al. | 272/76 |
| 4,749,184 | 6/1988 | Tobin | 272/76 |

OTHER PUBLICATIONS

Power Fist Board Holder–Black Belt Magazine, 1/1976, p. 18.

*Primary Examiner*—Richard J. Apley
*Assistant Examiner*—Franklin L. Gubernick
*Attorney, Agent, or Firm*—Steele, Gould & Fried

[57] ABSTRACT

An adjustable target holder for martial arts training has a base, a vertical support post and an elongated bi-sectional arm. The first arm is hollow, is slidably attached to the post, and has an open distal end. The second arm is solid and includes an extension received in the first arm's hollow interior. The second arm extension rotates inside the first arm. The second arm is rotated and locked into a selected position by means of a push button and follower detent which is urged into one of a series of depressions in the first arm's interior. The second arm's distal end includes a chamber into which a target end is placed. The target end is held firmly in the second arm by wedges which are positioned by a rack and pinion. When a handle operably connected to the rack and pinion is turned, the wedges move to hold the target. The second arm is then rotated into a desired position, supporting the board horizontally, vertically, or diagonally.

9 Claims, 3 Drawing Sheets

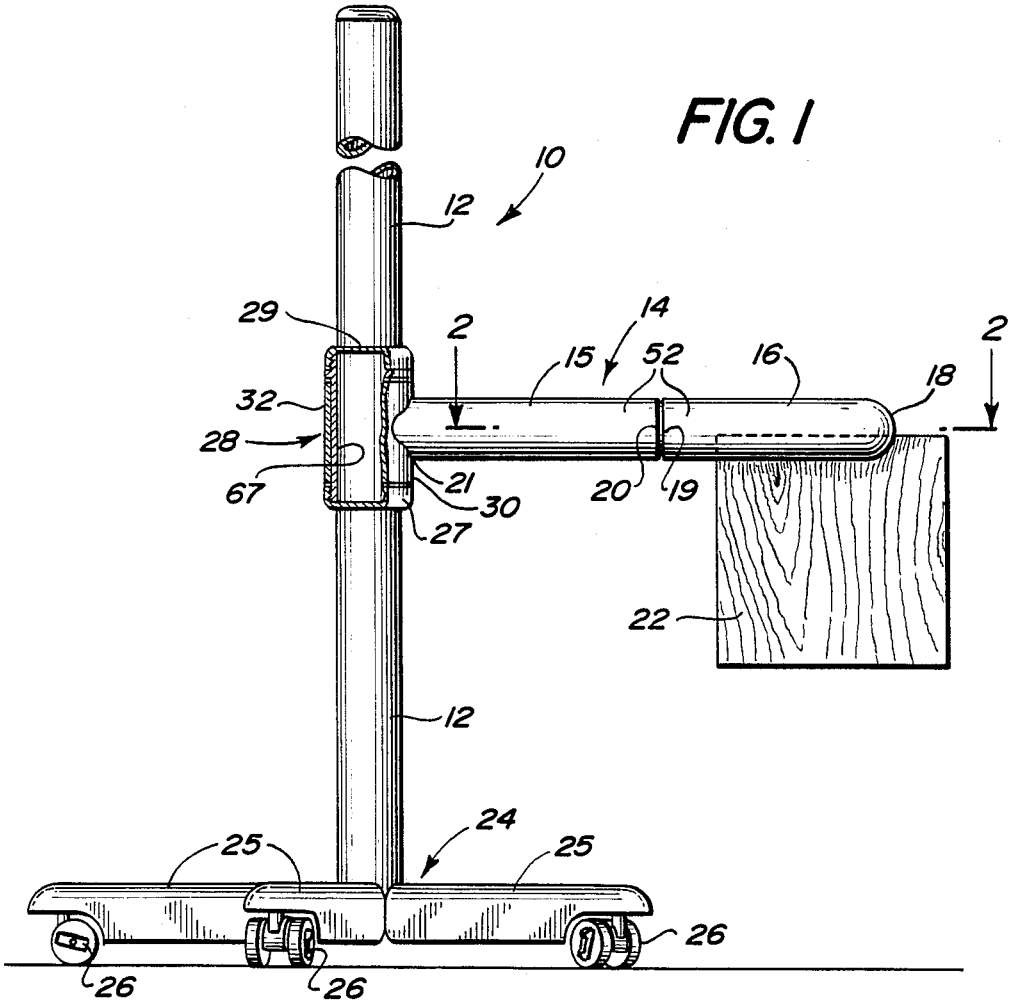
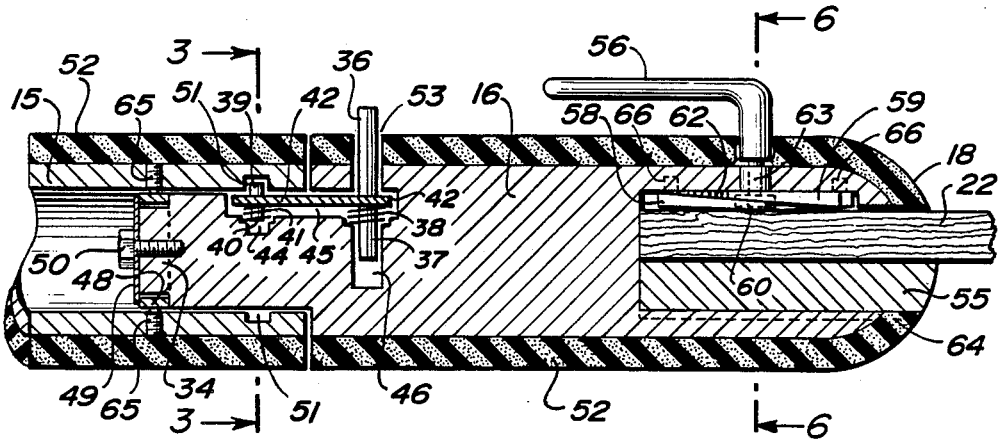
FIG. 2

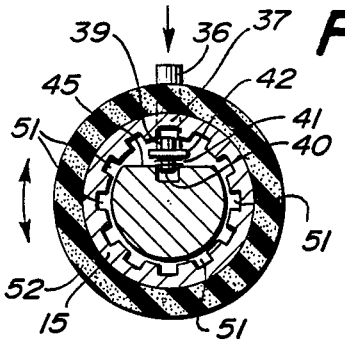
FIG. 3
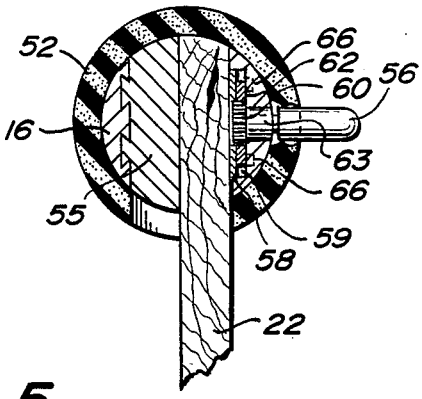
FIG. 6
FIG. 5
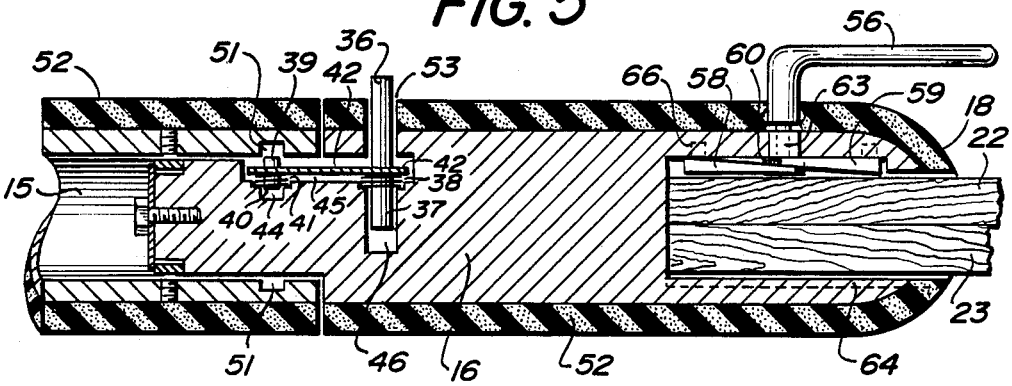
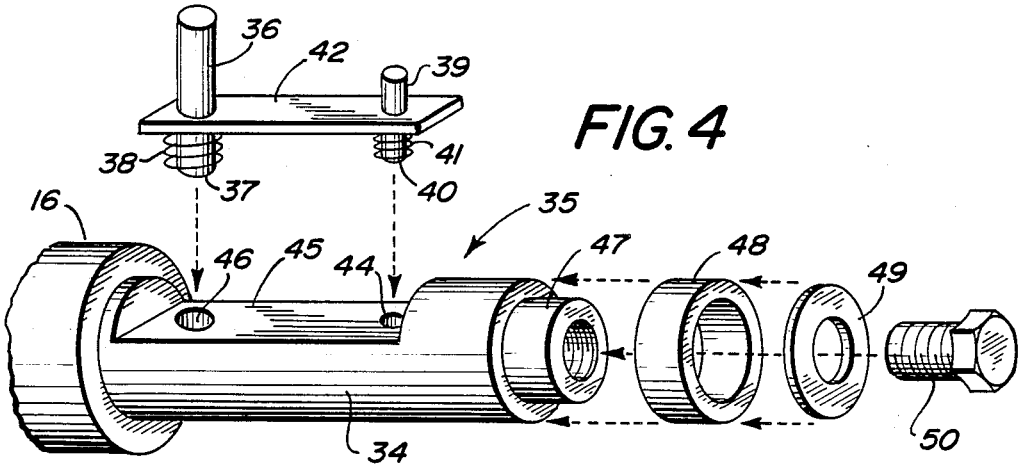
FIG. 4

ADJUSTABLE TARGET HOLDER FOR MARTIAL ARTS TRAINING

BACKGROUND OF THE INVENTION

1. Field of the Invention

This invention relates to horizontally supported planar surfaces and, in particular, to a horizontally adjustable target holder.

2. Description of the Prior Art

Today there is a great emphasis on physical fitness. Popular with many people are karate and other martial arts which offer the practitioners both physical fitness and self-protection. More advanced students of the martial arts often use hands and feet for breaking bricks, boards, or the like. Commonly, planar objects, such as boards, are supported by resting their ends on concrete blocks, creating a space for the board to span. The user then hits downward on the board to break it. Such breaking can be hazardous since the pieces may fly upward or bounce off the floor or table on which the concrete blocks were placed. Also, such a method of support allows only downward striking of the supported object. Advanced practitioners also kick and strike at objects in upward or sidewards motions and, therefore, need targets firmly held at a variety of levels and angles.

There is, therefore, a need for a target support for practice of the martial arts, and, in particular, a support which holds a target board, or the like, in both horizontally and vertically adjustable positions, for striking by the user.

SUMMARY OF THE INVENTION

The aforementioned prior art problems are obviated by the adjustable target holder of this invention in which a target holding bi-sectional arm extends horizontally from a vertical support post and may be raised or lowered. The vertical support post extends perpendicularly from a preferably wheeled base. The bi-sectional arm includes a fixed hollow cylindrical first arm having a proximal end for attachment to the post and an open distal end. A preferably solid cylindrical second arm includes an extension at its proximal end, the extension having a diameter less than the diameter of the first arm, and means to rotatably and lockably retain it in the first arm. The second arm includes means at its distal end to removably retain and position a target end.

The means to rotatably and lockably retain the second arm extension preferably includes a plurality of identical angularly spaced depressions in the first arm's inner circumference. A spring loaded push button located in and extending through the second arm is connected by a plate to a spring loaded follower detent located in the extension, the follower detent received by one of the selected angularly spaced depressions in the first arm. When the push button is depressed and held, the follower detent is likewise depressed to permit manual rotation of the second arm. Releasing of the push button causes the detent to be urged into a succeeding one of the angularly spaced depressions.

The second arm includes a crank handle extending outward from it and a target receiving chamber. A rack and pinion and a set of two wedges, operably connected at their narrow ends to the rack's underside, are located in the chamber. The crank handle is operably connected at one end to the pinion. When a target end (such as a board edge) is placed in the chamber, turning the handle causes the wedges to press against and hold the target end in the chamber.

Thus, the target holder can position the target for kicking and striking in many positions by raising or lowering the arm assembly and turning the second arm in relationship to the first arm. For example, for jump front kicks, axe kicks, and the soto hand chop, the target must be parallel to the ground. For some front kicks, round house kicks, back kicks, side kicks, spinning kicks, hook kicks, hand center punches, elbow strikes and back fists, the target must be held perpendicular to the ground. For other jump kicks, front kicks, and round house kicks, the target must be at a 45° angle to the ground. All of these target positions are possible with the target holder of this invention.

It is, therefore, an object of this invention to provide a target holder for the practice of the martial arts which holds a target vertically at varying heights and horizontally at various angles.

It is another object of this invention to provide a target holder for practice of the martial arts which holds one or more boards by a rack and pinion mechanism.

It is a further object of this invention to provide a target holder for the practice of the martial arts which adjusts the target position for kicks and strikes made from different positions.

It is yet another object of this invention to provide a target holder for the practice of the martial arts which utilizes a rotating bi-sectional arm.

It is a further object of this invention to provide a target holder for the practice of martial arts which is padded to absorb shock.

These and other objects will be more readily ascertainable to one skilled in the art from a consideration of the following Figures, description and exemplary embodiments.

BRIEF DESCRIPTION OF THE DRAWING(S)

FIG. 1 is an isometric side view of the target holder of this invention with a wheeled base, holding a target board in a vertical position and showing the collar in partial cut-away.

FIG. 2 is a cross section taken on lines 2—2 of FIG. 1 illustrating the first and second arms in locked relationship, the second arm with a target end held between the wedges and a filler.

Figure 7:
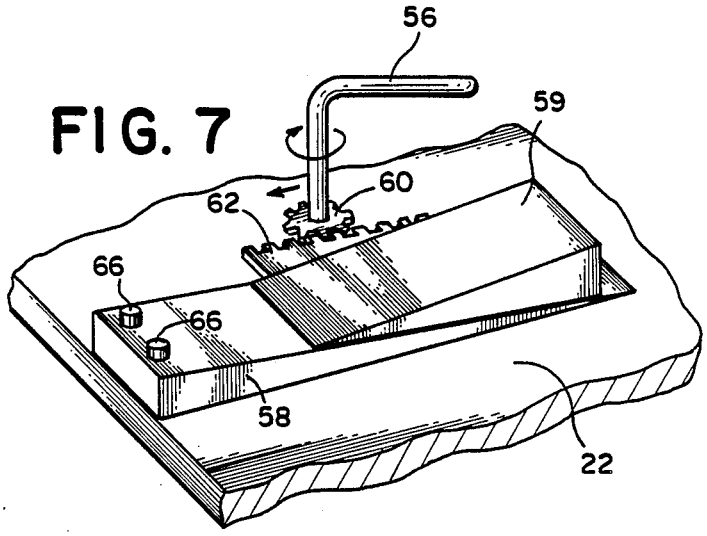

FIG. 3, a cross section taken on lines 3—3 of FIG. 2, illustrates the push button, follower detent, and the depressions in the first arm.

FIG. 4 is an exploded and enlarged view of the second arm extension and the push button and follower detent assembly.

FIG. 5 is a cross section of the arm showing the arms in rotating position and illustrating two boards held in the second arm chamber.

FIG. 6 is a cross section taken on lines 6—6 of FIG. 2 illustrating the rack and opinion and wedges holding a board and filler in the second arm chamber.

FIG. 7 is a partial perspective view showing the wedges and the arm fastening means.

DETAILED DESCRIPTION OF THE PREFERRED EMBODIMENT(S)

Referring now to the drawings, and more particularly to FIG. 1, target holder 10 is shown with base 24, vertical post 12 and arm 14. Base 24 preferably has four legs 25, each with a wheel 26. Although not shown, it is preferred that wheels 26 be supplied with locks, as is common in the art. Vertical post 12 extends upward from base 24 and is preferably centered for balanced use. Extending outward from post 12 is bi-sectional arm assembly 14 with first arm 15 and second arm 16. Arm 14 is slidably held to post 12 at proximal end 21 of first arm 15 by collar assembly 28. Arms 15 and 16 are joined at distal end 20 of first arm 15 and proximal end 19 of second arm 16. Arm 14 is circumferentially padded with, preferably, either polyurethane or polyethelene padding 52. Board 22 is seen extending downward from distal end 18 of second arm 16.

It is important that target holder 10 be able to hold a target, such as board 22, at varying heights along the length of post 12. Each martial arts student needs to vertically adjust the height of arm 14 to suit his own height, the exercise that is to be done, and his ability. For that reason, collar assembly 28 provides for height adjustment of arm 14. The method of height adjustment would be by conventional means and preferably would allow arm 14 to swing away from the user under variable loads. First arm 15 has proximal end 21 which includes end piece 30. End piece 30 is generally cylindrical and has an inner diameter greater than the outer diameter of post 12.

Now referring to FIGS. 2, 3, 4 and 5, the rotation of second arm 16 in first arm 15 is explained. Arms 15 and 16 are seen joined by extension 34 of arm 16. Arm 15 has a plurality of angularly spaced depressions 51 in its inner circumference. Arm extension 34 has a reduced diameter which is slightly less than the diameter of the inner circumference of arm 15. Extension 34 also includes a reduced interiorly threaded end 47 onto which collar 48 is fitted. Threaded bolt 50 is turned onto end 47 to hold collar 48 and washer 49 thereon. Washer 49 has a slightly larger diameter than collar 48. Restraining pins 65 extend inward through arm 15 to press against collar 48. Collar 48 is then held between washer 49 and extension 34 to rotatably and frictionally support extension 34 in arm 15. If extension 34 wobbles or shifts, pins 65 are tightened. Additionally, bolt 50 and washer 49 prevent collar 48 from moving laterally.

Central to the arm rotation see the rotation means 35 illustrated exploded in FIG. 4. Push button 36 and follower detent 39 are both spring loaded with springs 38 and 41, respectively. Plate 42 operably connects push button 36 and follower detent 39 and includes apertures through which push button continuation 37 and follower detent continuation 40 extend. Continuations 37 and 40 keep rotation means 35 aligned by preventing movement of plate 42 when push button 36 and detent 39 are depressed. Second arm 16 includes, on extension 34, cutaway portion 45 to receive plate 42 and channels 46 and 44 to receive push button continuation 37 and follower detent continuation 40, respectively. When push button 36 is depressed, continuation 37 is urged into channel 46, and when follower detent 39 is depressed by reciprocal movement of plate 42 and springs 38 and 41, continuation 40 is urged into channel 44.

Now referring to FIG. 5, in order to rotate arm 16, push button 36, which extends outward through aperture 53 in arm 16, is depressed, tilting plate 42 which in turn causes depression of follower detent 39. Continuations 37 and 40 are urged into their respective channels 44 and 46. Arm 16 can now rotate inside arm 15 until a desired position is reached. Then push button 36 is released, thereby releasing follower detent 39 which then moves (as a user turns arm 16) into the next successive one of the angularly spaced depressions 51, preventing further rotation. This locked position is illustrated in FIGS. 2 and 3.

Also shown in FIGS. 2, 3, 5, and 6 is circumferential padding 52 which surrounds both arms 15 and 16 and is, preferably, polyurethane to absorb shock. Padding 52 includes aperture 53 to receive push button 36.

Now referring to FIGS. 2, 5 and 6, the manner of supporting a target is described. Second arm 16 includes, at distal end 18, chamber 64 to receive a target 22. It is preferred that chamber 64 be a slot to closely receive planar boards and the like; however, it is possible that chamber 64 could be shaped otherwise to receive targets with differently shaped ends. Chamber 64 is, preferably, wide enough to receive two boards, so that when only one target board 22 is used (as shown in FIGS. 1, 2 and 6), filler 55 is used to fill the remaining space in chamber 64. Board 22 is held by stationary wedge 58 and moving wedge 59 which are tightened by rack 62 and pinion 60. This action is illustrated schematically in FIG. 7. Stationary wedge 58 is secured by detents 66.

To position a target in target holder 10, the end of board 22, or the like planar object, is placed in chamber 64. Filler 55 is positioned against board 22. As illustrated in FIGS. 2 and 6, crank handle 56 is turned, operating pinion 60 through pin 63. Rack 62, located on the top of wedge 59, is moved by pinion 60, moving wedge 59 until wedges 58 and 59 have been pushed tightly against board 22. Board 22 is then held firmly enough that it can be broken by a kick or a strike and not be knocked loose from chamber 64.

In FIG. 6, crank handle 56 is shown in the open position and a second target board 23 has been substituted for filler 55. This arrangement with two target boards provides a more difficult task for the user, that of breaking two boards at once.

There are several variations which can be practiced in the scope of this invention. First, the target is preferred to be planar and chamber 64 is, therefore, a slot. However, other target shapes are possible and chamber 64 may be shaped accordingly and still be within the scope of this invention.

Second, although base 24 is shown with four legs and wheels, other base arrangements are within the scope of this invention.

Coil springs 38 may be replaced with other spring action mechanisms.

The materials of construction may vary. Steel or aluminium is preferred for the body parts, but any suitably strong material may be substituted.

Vertical adjustment is illustrated with a collar and end cap arrangement. Other standard methods of providing for slidable adjustment are within the scope of this invention if they can withstand the sudden force of the kicks and strikes.

There are many advantages to the target holder of this invention. First, it holds a target in a variety of positions relative to the ground and the target holder, suitable for different strikes and kicks.

Second, it is vertically adjustable, accommodating users of different heights.

Having now illustrated and described my invention, it is not intended that such description limit this invention, but rather that this invention be limited only by reasonable interpretation of the appended claims.

What is claimed is:

1. An adjustable target holder for martial arts training , comprising:

a vertical support post and means to support said post to extend perpendicularly from a supporting surface;

an elongated bi-sectional arm including:

(i) a first arm having a proximal end for attachment to said post and a distal end;

(ii) a second arm, including an extending section rotatably attachable to said distal end of the first arm, one of the first arm and the extending section of the second arm having a diameter less than the diameter of the other of said first arm and the extending section of the second arm , whereby said first arm and said second arm fit within one another ;

means to slidably retain said elongated bi-sectional arm at the proximal end of the first arm on said post;

means to rotatably and lockably retain said extending section, including a plurality of identical angularly spaced depressions around a circumference of one of the first arm and the second arm, proximate the distal end of the first arm, and a spring loaded push button mounted on and extending from the other of said first and said second arm, the spring loaded push button being operably connected to a spring loaded follower, the spring loaded follower being mounted to be depressed by depression of said push button, permitting relative rotation of the first arm and the second arm, and upon release of the spring loaded push button, the spring loaded follower engaging in one of the angularly spaced depressions, fixing the second arm relative to the first arm ;

means located in said second arm to removably retain and position a target; and, means to prevent lateral movement of the second arm in the first arm, including a collar and collar mounting means mounted in the first arm and the extending section of the second arm, the collar and collar mounting means frictionally engaging one another to prevent said lateral movement .

2. The target holder according to claim 1, wherein said means to support the post includes a base provided with a plurality of wheels and at least one wheel locking means.

3. The target holder according to claim 1 wherein said collar mounting means includes at least one adjustable retaining pin extending transversely inward from said first arm to adjustably press against said collar to hold it in place.

4. The target holder according to claim 1 including, additionally, a washer and threaded holding pin to position said collar in said first arm.

5. The target holder according to claim 1 , wherein said means to removably retain a target in said second arm includes:

(a) a chamber in said second arm;

(b) a rack and pinion operably connected and located in said chamber;

(c) a set of two wedges , one of the wedges being operably connected to said rack on an underside thereof ; and, (d) a crank handle extending outwardly from said second arm and operably connected to said pinion, whereby turning of said handle relatively displaces said wedges to slide over one another and against said target in said chamber.

6. The target according to claim 5, further comprising a filler to aid in holding said target ,the filler being removably mountable in the chamber.

7. The target holder according to claim 1 including, additionally, circumferential, shock absorbing padding around each of said arms.

8. An adjustable target holder for martial arts training comprising:

a vertical support post and means to support the post to extend perpendicularly from a supporting surface;

an elongated bi-sectional arm including:

(i) a first arm having a proximal end for attachment to said post and a distal end;

(ii) a second arm, including an extending section rotatably attachable to said distal end of the first arm, one of the first arm and the second arm having a diameter less than the diameter of the other of said first arm and the extending section of the second arm, whereby the first arm and the second arm fit together;

means to slidably retain said elongated bi-sectional arm at the proximal end of the first arm on said post;

means to rotatably and lockably retain said extending section, including a plurality of angularly spaced depressions around a circumference of one of the first arm and the second arm, proximate the distal end of the first arm, and a spring loaded push button mounted on and extending from the other of said first and said second arm, the spring loaded push button being operably connected to a spring loaded follower, the spring loaded follower being mounted to be depressed by depression of said push button, thereby permitting relative rotation of the first arm and the second arm, and upon release of the spring loaded push button, the spring loaded follower engaging in one of the angularly spaced depressions, fixing the second arm relative to the first arm , said means to rotatably and lockably retain the second arm including a plate with apertures sized to receive said push button and said follower, and wherein said push button and said follower each have continuations extending through said plate , a spring being located between said continuations and said plate, one of said first arm and said second arm having a cut-away area to receive said plate and channels to receive said push button and said follower continuations.

9. The target holder according to claim 8, further comprising means to prevent lateral movement of said second arm in said first arm.

* * * * *